US010283904B2

(12) United States Patent
Amemiya et al.

(10) Patent No.: US 10,283,904 B2
(45) Date of Patent: May 7, 2019

(54) CONNECTOR

(71) Applicant: Yazaki Corporation, Tokyo (JP)

(72) Inventors: Daiki Amemiya, Tokyo (JP); Kazuto Ohtaka, Shizuoka (JP); Kyouhei Kamimura, Tokyo (JP); Sho Kawano, Tokyo (JP); Tohru Kurosawa, Tokyo (JP); Yoshihiro Iwahori, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 16/052,607

(22) Filed: Aug. 1, 2018

(65) Prior Publication Data

US 2019/0044278 A1 Feb. 7, 2019

(30) Foreign Application Priority Data

Aug. 4, 2017 (JP) ..... 2017-151355
Apr. 4, 2018 (JP) ..... 2018-072287

(51) Int. Cl.
*H01R 13/62* (2006.01)
*H01R 13/627* (2006.01)
*H01R 13/639* (2006.01)
*H01R 13/641* (2006.01)

(52) U.S. Cl.
CPC ..... *H01R 13/6272* (2013.01); *H01R 13/639* (2013.01); *H01R 13/641* (2013.01)

(58) Field of Classification Search
CPC ..... H01R 13/6272; H01R 13/639; H01R 13/13641
USPC ..... 439/352
See application file for complete search history.

(56) References Cited

U.S. PATENT DOCUMENTS 5,605,472 A 2/1997 Sakai et al.
5,928,038 A * 7/1999 Berg ..... H01R 13/6272 439/489
6,582,243 B2 * 6/2003 Endo ..... H01R 13/6272 439/352
7,043,834 B2 * 5/2006 Endo ..... H01R 13/641 29/842
8,485,836 B2 * 7/2013 Nakamura ..... H01R 13/4223 439/188
8,628,344 B2 * 1/2014 Cole ..... H01R 13/6272 439/352

(Continued)

FOREIGN PATENT DOCUMENTS

JP 8-31517 A 2/1996
JP 2002-260781 A 9/2002

*Primary Examiner* — Alexander Gilman
(74) *Attorney, Agent, or Firm* — Kenealy Vaidya LLP

(57) ABSTRACT

A connector (1) includes a terminal, a housing (20) that accommodates and holds the terminal and is engaged with a mating housing (Ch) by being releasably locked by causing a locking portion (31*b*) to be locked to a locked portion (31*a*) provided in the mating housing (Ch) when an engagement state with a mating connector (C) is a complete engagement state, and a detection member (40) that is assembled to the housing (20) and is relatively movable in an engagement direction and a detachment direction with respect to the housing (20) between a main locking position when the engagement state is the complete engagement state and a locking release position when the engagement state is an engagement release state in which the complete engagement state is released.

16 Claims, 12 Drawing Sheets

(56) References Cited

U.S. PATENT DOCUMENTS

| | | | | |
|---|---|---|---|---|
| 8,769,782 | B2 * | 7/2014 | Fujikawa | H01R 13/506<br>24/593.1 |
| 8,926,355 | B2 * | 1/2015 | Heil | H01R 13/641<br>439/352 |
| 9,160,095 | B2 * | 10/2015 | Littek | H01R 13/422 |
| 9,484,684 | B2 * | 11/2016 | Tanikawa | H01R 13/6275 |
| 9,935,399 | B2 * | 4/2018 | Sekino | H01R 13/641 |
| 2002/0119695 | A1 * | 8/2002 | Kozono | H01R 13/641<br>439/488 |

* cited by examiner

CONNECTOR

CROSS-REFERENCE TO RELATED APPLICATION(S)

The present application claims priority to and incorporates by reference the entire contents of Japanese Patent Application No. 2017-151355 filed in Japan on Aug. 4, 2017 and Japanese Patent Application No. 2018-072287 filed in Japan on Apr. 4, 2018.

BACKGROUND OF THE INVENTION

1. Field of the invention

The present invention relates to a connector.

2. Description of the Related Art

Conventionally, in a connector, there is known a technique for allowing a worker or the like to determine whether an engagement state with a mating connector is complete. For example, the connector includes a detection member capable of relative movement with respect to a housing between a temporary locking position and a main locking position (see the following Japanese Patent Application Laid-open No. 2002-260781 and Japanese Patent Application Laid-open No. H8-31517). The detection member is not capable of moving from the temporary locking position to the main locking position unless the engagement state between the connector and the mating connector (between the connectors) is complete (is in a so-called engagement release state), but capable of moving from the temporary locking position to the main locking position if the engagement state is complete (is in a so-called complete engagement state). The worker or the like can determine whether the engagement state between the connectors is complete based on such a relative positional relationship of the detection member with respect to the housing.

Meanwhile, when releasing locking of both housings, the detection member is operated to move from the main locking position to the temporary locking position in the complete engagement state, a lock arm operating portion provided on a lock arm is further operated to release locking between a locking portion provided on the housing and a locked portion provided on the mating housing, and the connectors are further moved in directions of being separated from each other, thereby performing engagement release between the connectors. However, the movement operation of moving the detection member from the main locking position to the temporary locking position and the locking release operation of releasing the locking between both the housings are performed using different members, and thus, there is a problem in workability until the release of locking between both the housings.

SUMMARY OF THE INVENTION

The present invention has been made in view of the above description, and an object thereof is to provide a connector capable of easily performing engagement release between the connectors.

In order to solve the above-described problem and to achieve the object, according to an aspect of the present invention, a connector includes a terminal; a housing that accommodates and holds the terminal and is engaged with a mating housing by being releasably locked by causing a locking portion to be locked to a locked portion provided in the mating housing when an engagement state with a mating connector is a complete engagement state; and a detection member that is assembled to the housing and is relatively movable in an engagement direction and a detachment direction with respect to the housing between a main locking position when the engagement state is the complete engagement state and a locking release position when the engagement state is an engagement release state in which the complete engagement state is released. The housing includes a main body, a lock wall that opposes the main body in an opposing direction, which is a direction orthogonal to the engagement direction, and sandwiches the locking portion together with the main body at the main locking position, and a flexible lock arm that is fixed to the main body. The detection member is attachable to the lock arm. The lock arm includes the locking portion, a base portion which extends in the engagement direction with one end fixed to an outer peripheral surface of the main body and has the locking portion at another end, and a release lever portion which extends in the detachment direction along the lock arm with one end connected to the locking portion. The release lever portion includes a support portion opposing the outer peripheral surface of the main body in the opposing direction. The detection member includes a detection member operating portion at least a part of which is positioned between the lock wall and the locking portion at the main locking position and which opposes the main body with the support portion sandwiched between the detection member operating portion and the main body and is positioned on a side in the detachment direction of the locking portion without being positioned between the lock wall and the locking portion at the locking release position.

According to another aspect of the present invention, in the connector, the detection member operating portion may have a release operation surface which is positioned on a side in the engagement direction and faces the detachment direction.

According to still another aspect of the present invention, in the connector, the detection member may be detachable from the lock arm, and the release lever portion may include a lock arm operating portion which opposes the main body with the support portion sandwiched between the release lever portion and the main body and is positioned on a side in the detachment direction of the support portion.

According to still another aspect of the present invention, in the connector, a gap may be formed between the support portion and the main body.

According to still another aspect of the present invention, in the connector, the support portion may be formed at a position overlapping one end of the base portion when viewed from a direction orthogonal to the engagement direction and the opposing direction.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Hereinafter, embodiments of a connector according to the present invention will be described in detail with reference to the drawings. Incidentally, the invention is not limited by the embodiments.

Embodiment

An X direction in FIGS. 1 to 12 is an insertion and removal direction of a connector 1 and a mating connector C in the present embodiment, and is a front-rear direction of a housing 20 and a mating housing Ch. A Y direction is an arrangement direction of the connector 1 and the mating connector C in the present embodiment, is orthogonal to the insertion and removal direction, and is a width direction of the housing 20 and the mating housing Ch. A Z direction is a vertical direction of the connector 1 and the mating connector C in the present embodiment, and is a direction orthogonal to the insertion and removal direction and the arrangement direction. An X1 direction is an engagement direction of the connector 1 and an X2 direction is a detachment direction of the connector 1. A Z1 direction is an upward direction of both the connectors and a Z2 direction is a downward direction of both the connectors. Each direction used in the following description indicates a direction in a state where the respective parts are assembled to each other unless otherwise specified.

Figure 1:
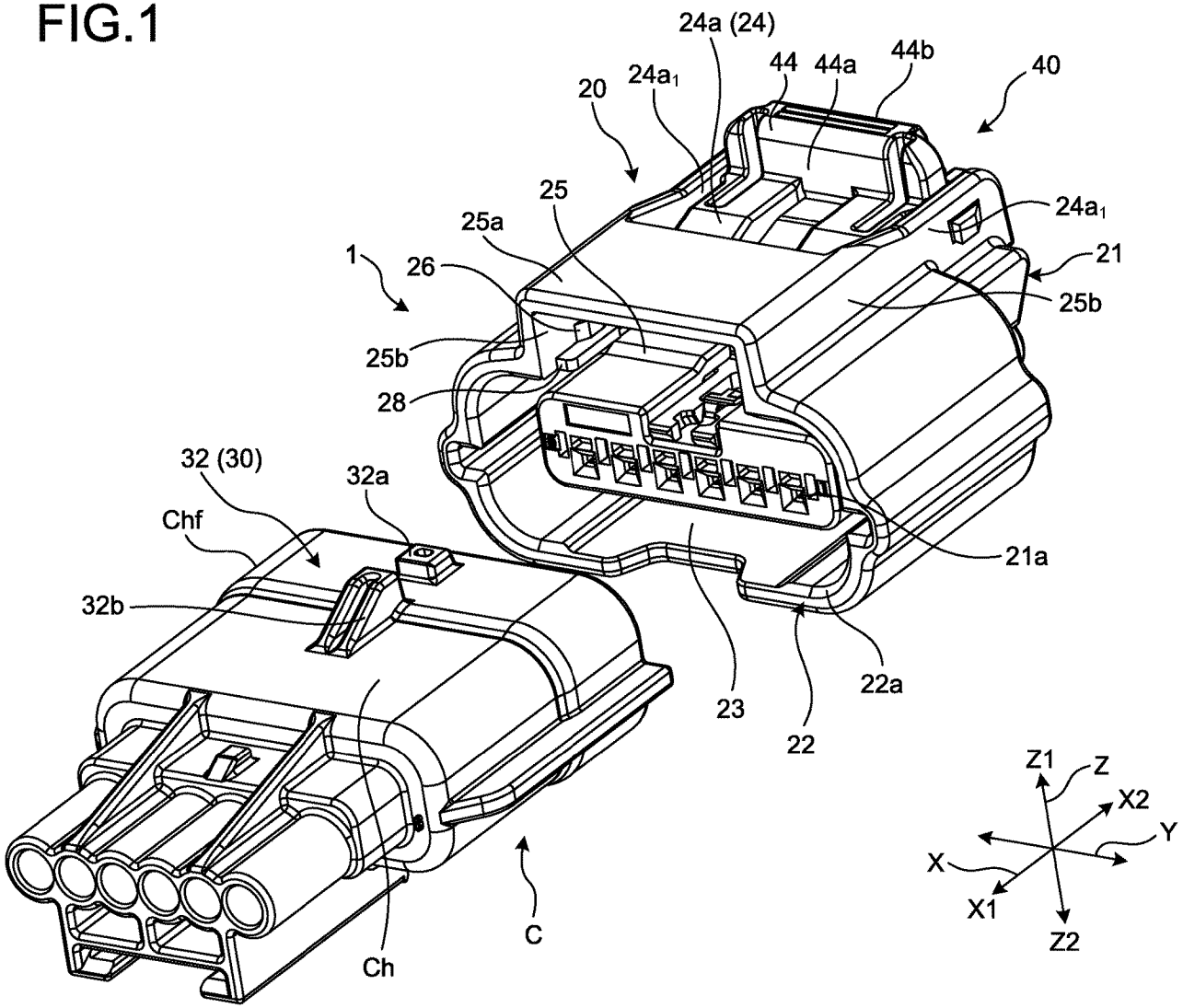
FIG. 1 is a perspective view illustrating a connector according to an embodiment and is the view illustrating a state before engagement with a mating connector.

As illustrated in FIG. 1, the connector 1 in the present embodiment is applied to, for example, a wire harness that is used in an automobile or the like. Here, the connector 1 is a connection mechanism for wire-to-wire connection that connects a plurality of electric wires constituting a wire harness, and is used in, for example, an air bag circuit. The connector 1 includes a terminal (not illustrated) and the housing 20 that accommodates and holds the terminal.

The terminal is molded in a predetermined shape using a conductive material such as metal, and a core wire of the terminal of the electric wire is physically and electrically connected in a predetermined connection mode such as crimping and welding. The terminal has a terminal connection portion to which a mating terminal of the mating connector C is connected and an electric wire connection portion to which the core wire of the electric wire is connected. In the present embodiment, the terminal of the connector 1 is molded as a female terminal, and the mating terminal of the mating connector C is molded as a male terminal. However, any of the terminal and the mating terminal may be the female terminal or the male terminal as long as the terminals are connected to each other physically and electrically upon being engaged with each other.

Figure 2:
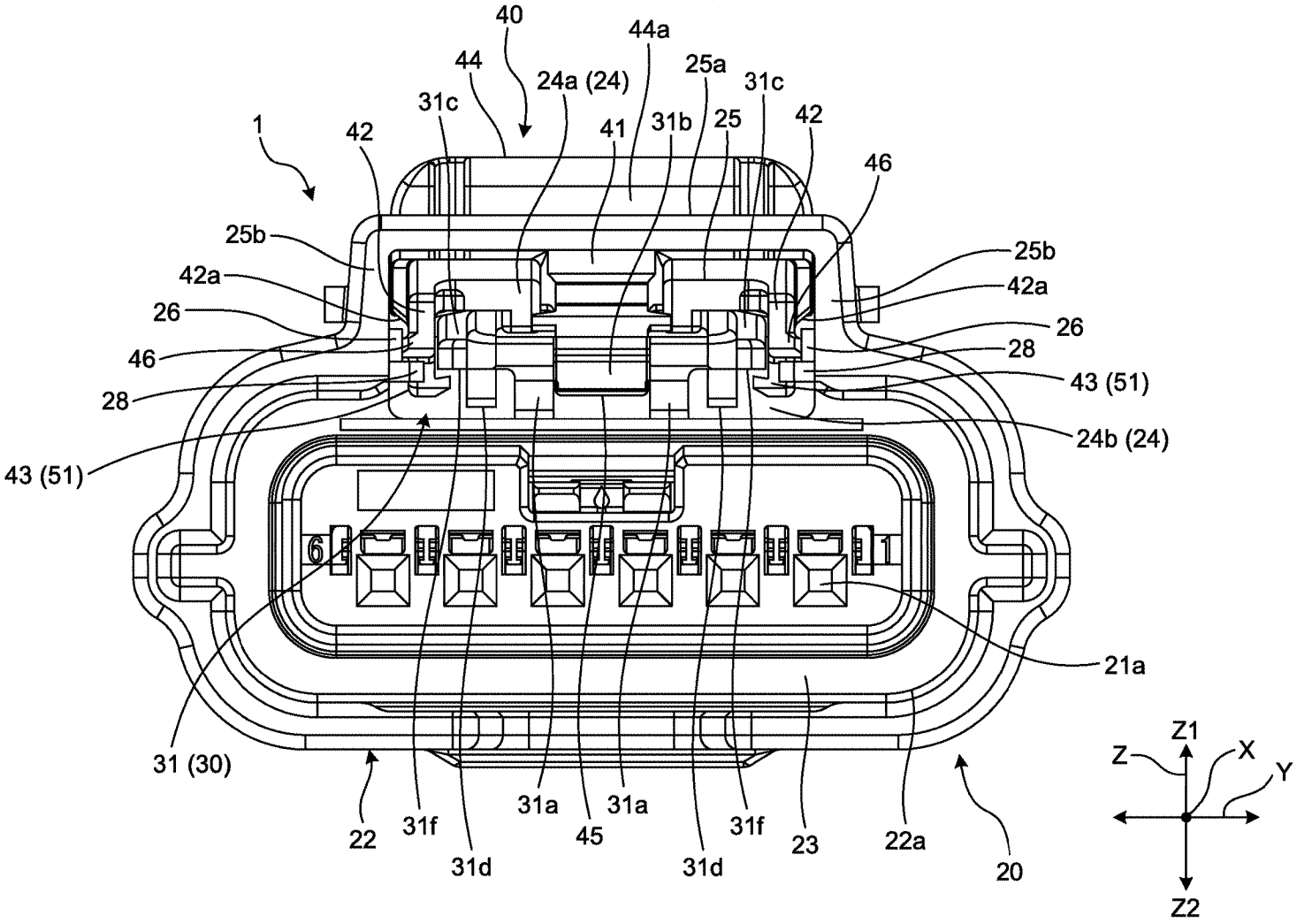
FIG. 2 is a front view of the connector of the embodiment viewed from the mating connector side.
Figure 3:
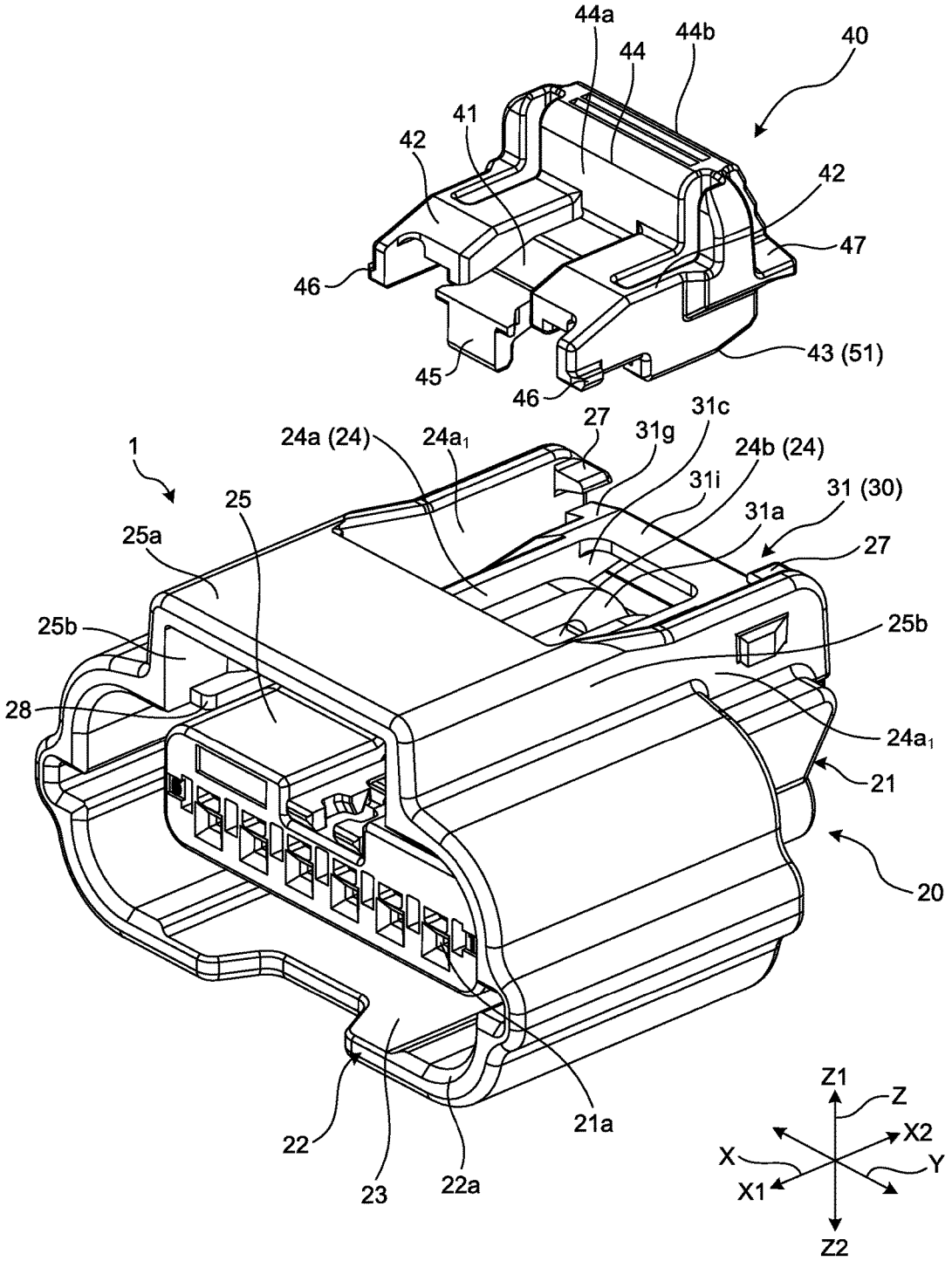
FIG. 3 is an exploded perspective view illustrating the connector according to the embodiment.
Figure 4:
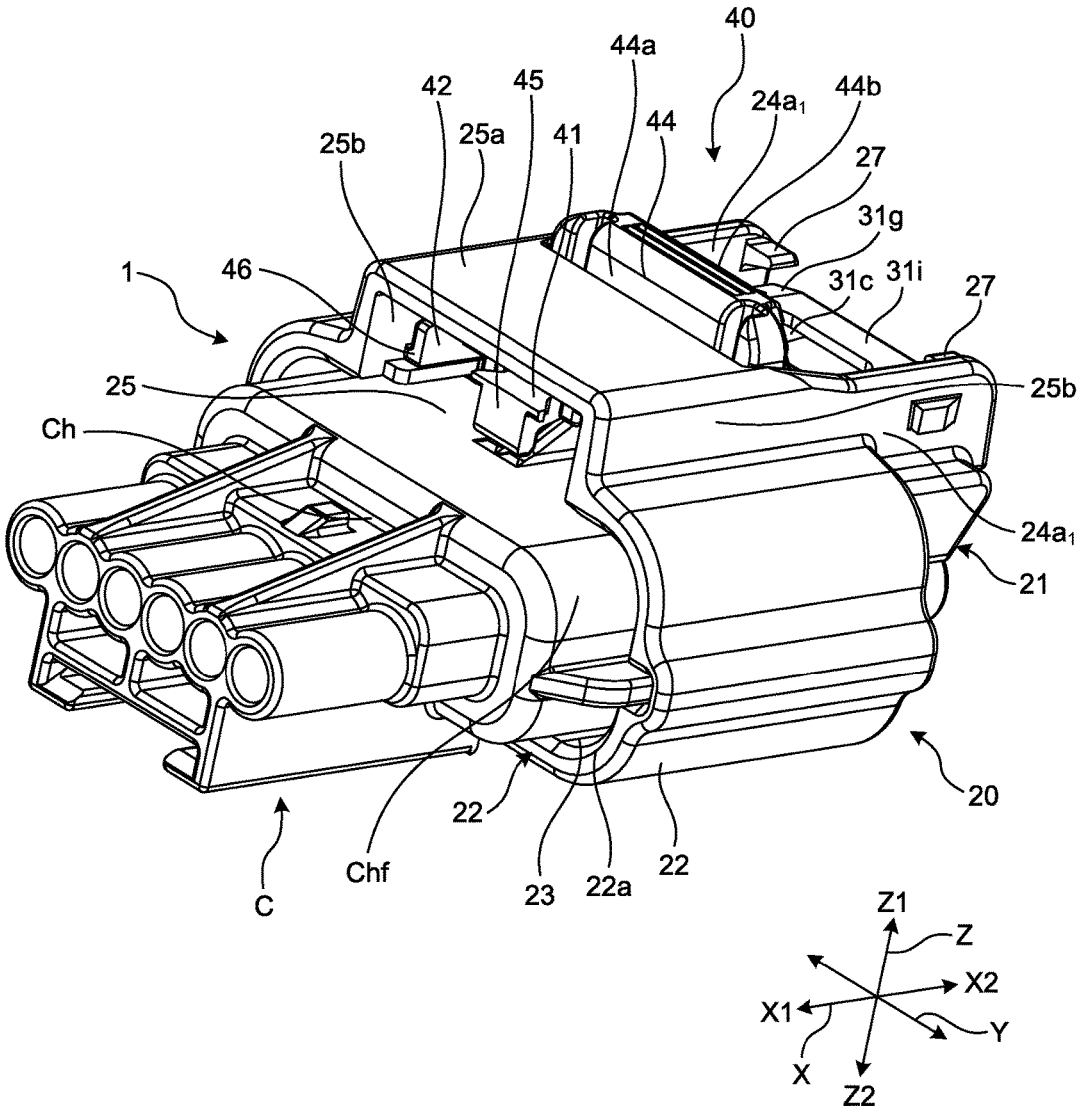
FIG. 4 is a perspective view illustrating the connector according to the embodiment and is the view illustrating a complete engagement state after completion of engagement with the mating connector.

As illustrated in FIGS. 2 and 3, the housing 20 is molded in a predetermined shape using an insulating material such as a synthetic resin, and includes a main body 21, a hood 22, an annular space 23, an operation groove 24, an accommodating space 25, a locking body 26, a housing protruding body 27, and a regulating rail 28.

Figure 5:
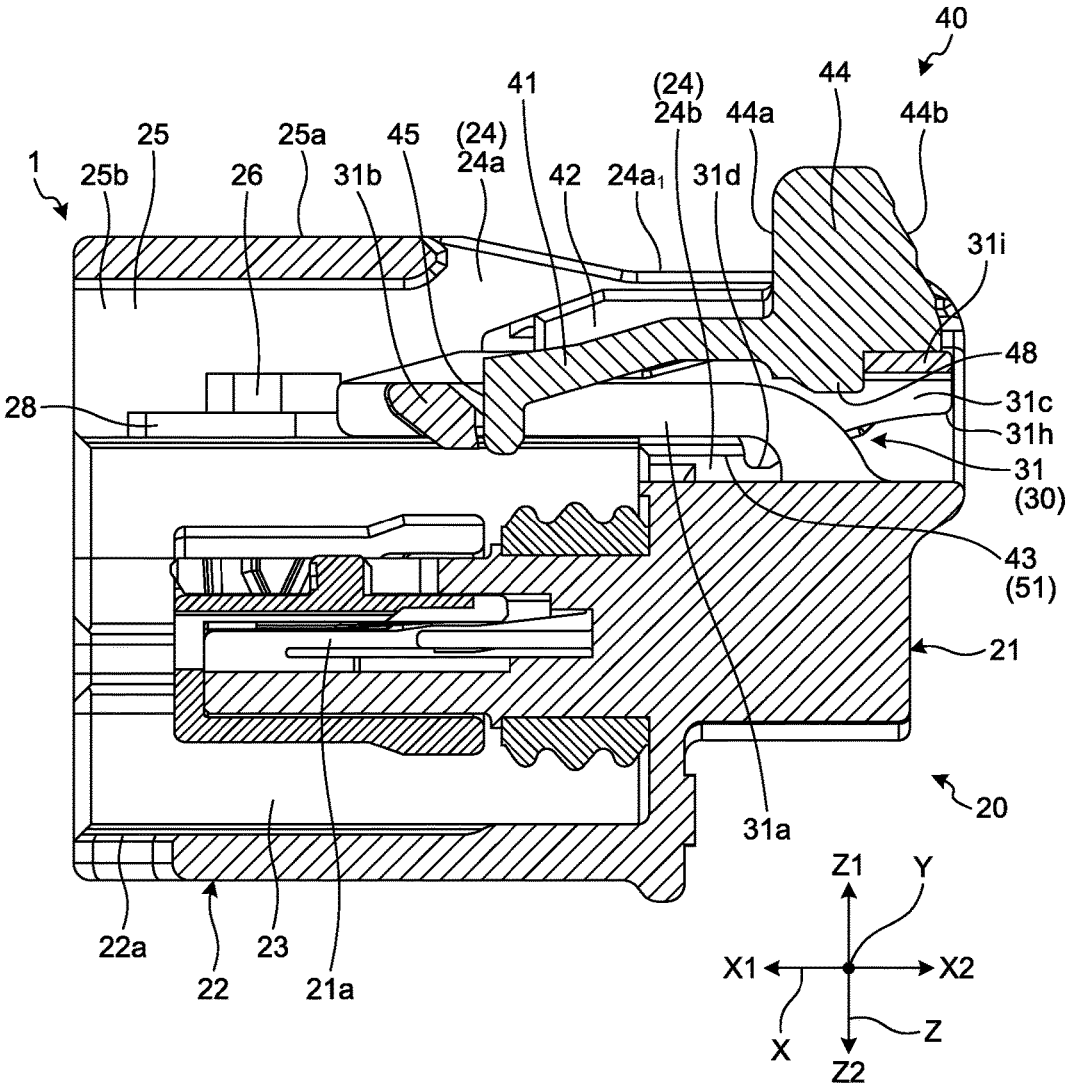
FIG. 5 is a cross-sectional view taken along a line X-X of FIG. 2.

As illustrated in FIG. 5, the main body 21 is provided with a plurality of terminal accommodating chambers 21*a* to accommodate and hold the plurality of terminals. Each of the terminal accommodating chambers 21*a* accommodates and holds the terminals one by one, and is formed so as to accommodate and hold the terminals one by one along the insertion and removal direction. The terminal accommodating chamber 21*a* has an opening on the engagement direction side, and the terminal connection portion of the terminal at the inner side is exposed outward through the opening. In a connector engagement step, the mating terminal is inserted into the terminal accommodating chamber 21*a* from the opening and is engaged with the terminal connection portion of the terminal. The terminal accommodating chamber 21*a* also has an opening on the detachment direction side, and the electric wire connected to the electric wire connection portion of the terminal at the inner side is drawn outward through the opening on the detachment direction side. The respective terminal accommodating chambers 21*a* of the present embodiment are arranged side by side in a lattice shape inside the rectangular parallelepiped main body 21 arranged inside the rectangular-tube-shaped hood 22 and protrude from the hood 22 toward the detachment direction.

As illustrated in FIGS. 1 and 2, the hood 22 has a cylindrical shape and is formed so that the main body 21 is arranged inside thereof. The hood 22 is arranged such that a cylinder axis direction thereof is along the insertion and removal direction. The hood 22 has an opening 22*a* on the engagement direction side. The mating connector C is inserted through the opening 22*a*. The hood 22 in the present embodiment is formed in a rectangular tube shape such that the terminal accommodating chambers 21*a* are arranged side by side in a lattice shape inside the rectangular parallelepiped main body 21 arranged at the inner side and the terminal accommodating chambers 21*a* protrude toward the detachment direction.

As illustrated in FIG. 1, the annular space 23 is formed between the main body 21 and the hood 22, a cylindrical hood Chf of the mating housing Ch in the mating connector C is accommodated so as to wrap the main body 21 at the inner side thereof in the connector engagement step between the connector 1 and the mating connector C. A plurality of mating terminals are accommodated and held inside the hood Chf.

As illustrated in FIG. 5, the operation groove 24 is formed so as to expose a part of a detection member 40, which will be described later, outward, and is provided so as to allow a worker or the like to perform an operation with respect to the detection member 40. The operation groove 24 has an operation space 24*a*, a side wall 24$a_1$, and a movable space 24*b*. The operation space 24*a* is a space portion in which the detection member 40 is exposed outward in the operation groove 24 and is used when the worker or the like performs the operation. The operation space 24*a* has the side wall 24$a_1$. A pair of the side walls 24$a_1$ is formed to oppose each other in the arrangement direction, and forms a part of an outer wall of the housing 20. The movable space 24*b* is a space provided between the detection member 40 and an outer peripheral surface of the main body 21 in the operation groove 24 and communicates with the annular space 23 on the engagement direction side.

As illustrated in FIG. 5, the accommodating space 25 is formed so as to be arranged closer to the engagement direction side than the operation space 24*a*, and communicates with the engagement direction side of the operation space 24*a*. The accommodating space 25 has a lock wall 25*a* and a side wall 25*b*. The lock wall 25*a* is formed so as to oppose the main body 21 in the upward direction on a side opposite to a side of the annular space 23 in the vertical direction and accommodates a part of the detection member 40. The side wall 25*b* is formed so as to be connected to both ends of the lock wall 25*a*, and a pair of the side walls 25*b* is formed to oppose each other in the arrangement direction. In addition, the lock wall 25*a* and the side wall 25*b* form a part of the outer wall of the housing 20.

As illustrated in FIG. 2, the locking body 26 is erected individually from each of the pair of side walls 25*b* of the accommodating space 25, and a pair of the locking bodies 26 is formed to oppose each other in the arrangement direction. One of the locking bodies 26 is formed to protrude toward the other locking body 26.

As illustrated in FIG. 3, the housing protruding body 27 is erected individually from each of the pair of side walls 24$a_1$ of the operation space 24*a*, and a pair of the housing protruding bodies 27 is formed so as to oppose each other in the arrangement direction. One of the protruding bodies 27 is formed to protrude toward the other protruding body 27. The protruding body 27 in the present embodiment is formed in a rectangular parallelepiped shape. When viewed from the engagement direction, the housing protruding body 27 is formed such that a side of the other protruding body 27 which is closer to a distal end side than the side wall 24$a_1$ on which the housing protruding body 27 as a base side is erected is short in the vertical direction, that is, a thickness, which is a length in the vertical direction, is thin.

As illustrated in FIG. 2, the regulating rail 28 is formed on each of the side walls 25*b*. The regulating rails 28 protrude so as to oppose wall bodies 42, which will be described later, of the detection member 40, respectively, and are formed and arranged so as to be capable of facing a locking protrusion 46 for main locking in the vertical direction in a detection member movement step. Therefore, when the detection member 40 is inserted into the accommodating space 25, the movement of the detection member 40 in the downward direction with respect to the housing 20 is restricted as each of the locking protrusions 46 for main locking comes into contact with each of the regulating rails 28 in the upward direction. In particular, even if the detection member 40 is pushed in the downward direction when the detection member 40 is at the main locking position, the downward movement of the detection member 40 with respect to the housing 20 is suppressed. Thus, it is possible to prevent a temporary locking release portion 45 from coming into contact with the cylindrical hood Chf of the mating housing Ch in a state where an excessive load is applied in the vertical direction. As a result, it is possible to improve durability of the connector 1.

Here, a state where the connector 1 and the mating connector C have been completely inserted into each other and the physical and electrical connection between the terminal and the mating terminal is established will be referred to as a complete engagement state. On the other hand, an engagement state between the connector 1 and the mating connector C (hereinafter also referred to as "between connectors") until the complete engagement state is formed in the connector engagement step or after the complete engagement state in a connector release step will be referred to as an engagement release state.

Figure 6:
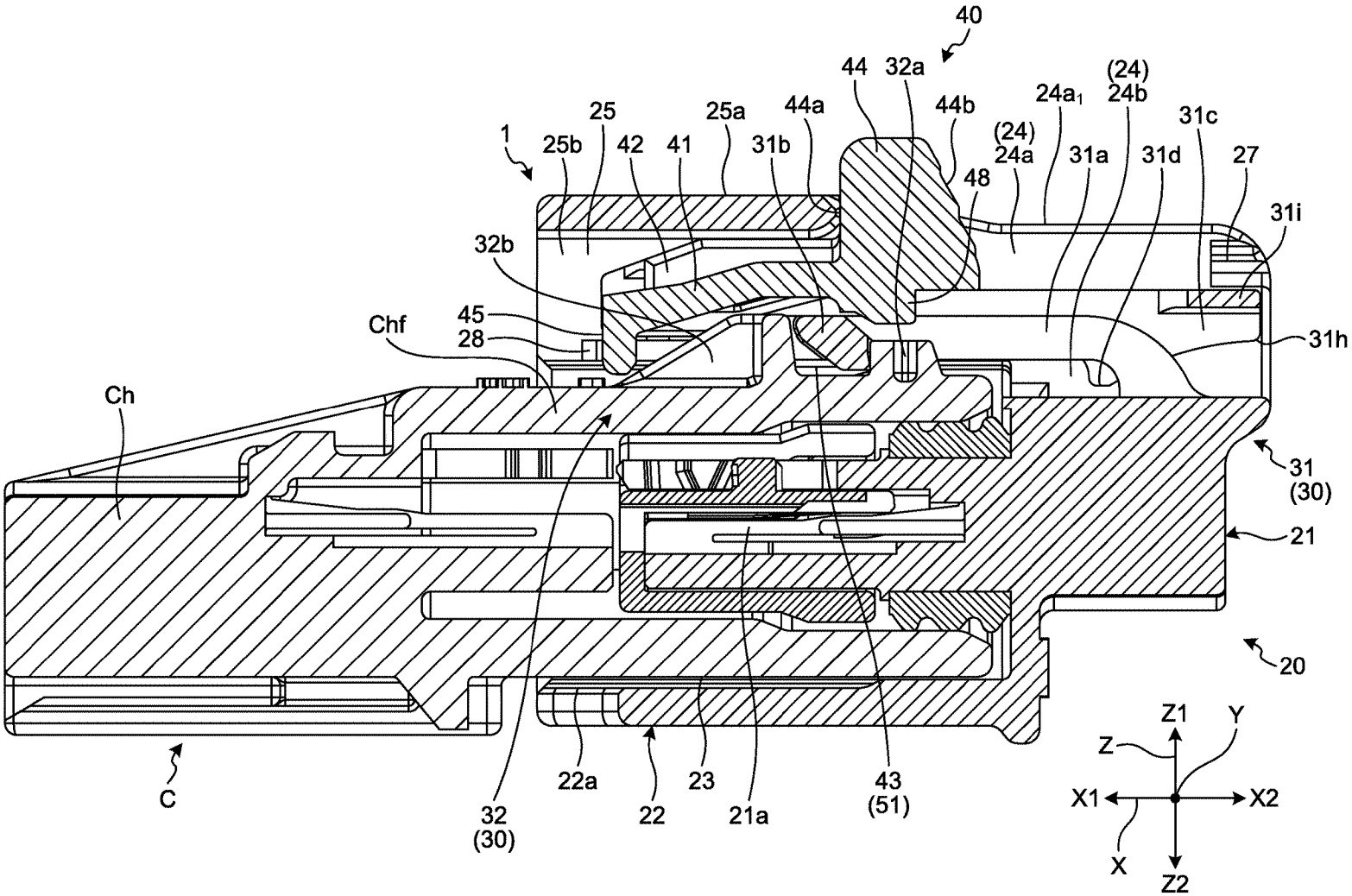
FIG. 6 is a cross-sectional view taken along a line Y-Y of FIG. 4 in which the connector in the complete engagement state and the mating connector are divided into two at the center.

As illustrated in FIG. 6, a holding structure 30, which causes the housing 20 and the mating housing Ch to be engaged with each other in the complete engagement state of the connector 1 and the mating connector C and holds the complete engagement state, is provided between the connector 1 and the mating connector C. The holding structure 30 is a so-called lock structure between connectors, and causes the housing 20 and the mating housing Ch to be engaged with each other when the engagement state between the connector 1 and the mating connector C is the complete engagement state and holds the complete engagement state as illustrated in FIG. 6. The holding structure 30 is formed of a lock arm 31 and a locked structure 32.

As illustrated in FIG. 5, the lock arm 31 is formed so as to be integrated with one of four outer peripheral surfaces of the main body 21, and holds the complete engagement state by being locked by the mating housing Ch. The lock arm 31 is fixed to the main body 21, has flexibility, and allows the detection member 40 to be attached thereto. In addition, the lock arm 31 includes a base portion 31*a*, a locking portion 31*b*, a release lever portion 31*c*, a support portion 31*d*, a guide portion 31*f*, and a lock arm protruding body 31*g*.

The base portion 31*a* is formed such that one end on the detachment direction side is curved downward and fixed to the outer peripheral surface of the main body 21 on the upward direction and the other end on the engagement direction side extends in the engagement direction.

The locking portion 31*b* is formed at the other end of the base portion 31*a* on the engagement direction side and is formed to oppose the lock wall 25*a* in the downward direction. The locking portion 31*b* locks a locked portion 32*a* provided in the mating housing C and locks the mating housing C to the housing 20 such that the locking therebetween can be released.

The release lever portion 31*c* is formed such that one end on the engagement direction side is connected to the locking portion 31*b* and the other end on the detachment direction side extends in the detachment direction. The release lever portion 31*c* is formed in a half arrowhead shape in which both side walls of the lock arm 31 extend in the engagement direction, and forms these side walls. The release lever portion 31*c* is configured such that the other ends on the detachment direction side of both the side walls of the lock arm 31 are connected by a connection portion 31*i* when viewed from the vertical direction. In addition, the release lever portion 31*c* has a support portion 31*d* and a contact portion 31*h*.

A gap is formed between the support portion 31*d* and the main body 21 in a state of the housing 20 alone. The support portion 31*d* opposes the outer peripheral surface of the main body 21 in the vertical direction and is formed so as to overlap one end of the base portion 31*a* on the detachment direction side when viewed from the arrangement direction.

The contact portion 31*h* does not come into contact with the outer peripheral surface of the main body 21 immediately after the support portion 31*d* comes into contact with the outer peripheral surface of the main body 21 as the lock arm 31 elastically changes, and comes into contact with the outer peripheral surface of the main body 21 as the lock arm 31 further elastically changes. The elastic deformation of the lock arm 31 toward the downward direction is restricted as the contact portion 31*h* of the lock arm 31 comes into contact with the outer peripheral surface of the main body 21, and thus, it is possible to suppress excessive deflection of the lock arm 31 and to suppress plasticization of the lock arm 31. Here, an end surface of the release lever portion 31*c* on the downward direction side is preferably a curved surface protruding toward the upward direction from a straight line connecting the contact portion 31*h* and the support portion 31*d* when viewed from the width direction. As a result, it is possible to suppress the contact with the other surface on the downward direction side before the contact portion 31*h* comes into contact with the outer peripheral surface of the main body 21 after the support portion 31*d* comes into contact with the outer peripheral surface of the main body 21.

As illustrated in FIG. 2, a pair of the guide portions 31*f* is formed such that detachment of the attached detection member 40 from the lock arm 31 (detachment in a direction different from the insertion and removal direction) can be suppressed. The guide portion 31*f* of the present embodiment is provided on the release lever portion 31*c*.

As illustrated in FIG. 3, a pair of the lock arm protruding bodies 31*g* is formed in a rectangular parallelepiped shape so as to face the side wall 24$a_1$. The lock arm protruding body 31*g* of the present embodiment is provided on the release lever portion 31*c*. When viewed from the engagement direction, the lock arm protruding body 31*g* is formed such that opposing sides facing the side walls 24$a_1$, which are on the distal end side of the release lever portion 31*c* on the base side, are short in the vertical direction, that is, a thickness, which is a length in the vertical direction, is thin.

The locked structure 32 is provided in the mating housing C and is formed such that the locking portion 31*b* is releasably locked. The locked structure 32 has the locked portion 32*a* and a release operating portion 32*b*.

As illustrated in FIG. 1, the locked portion 32*a* is a protruding body that protrudes from the outer wall surface of the hood Chf, and is formed so as to be capable of facing the locking portion 31*b* in the insertion and removal direction in the connector engagement step. The locked portion 32*a* is formed on the outer wall surface of the hood Chf so as to be positioned on the detachment direction side of the locking portion 31*b* in the complete engagement state. The locking portion 31*b* and the locked portion 32*a* may come into contact with each other in the insertion and removal direction in the complete engagement state, or may be arranged with an interval therebetween in the insertion and removal direction. However, when the interval is provided, the interval is set such that the complete engagement state is not damaged when the interval is shortened and the locking portion 31*b* and the locked portion 32*a* come into contact with each other. The locked portion 32*a* in this example is formed in a rectangular parallelepiped shape.

As illustrated in FIG. 1, the release operating portion 32*b* is a protruding body that protrudes from the outer wall surface of the hood Chf, and is formed so as to be capable of facing the locking portion 31*b* in the insertion and removal direction in the connector engagement step. The release operating portion 32*b* is formed on the outer wall surface of the hood Chf so as to be positioned on the engagement direction side of the locking portion 31*b* in the complete engagement state. The locking portion 31*b* and the release operating portion 32*b* may come into contact with each other in the insertion and removal direction in the complete engagement state, or may be arranged with an interval therebetween in the insertion and removal direction. The release operating portion 32*b* in this example is formed in a rectangular parallelepiped shape, and has an inclined surface formed on the engagement direction side.

As illustrated in FIG. 6, the connector 1 according to the present embodiment includes the detection member 40 which is formed so as to be relatively movable with respect to the housing 20 in the insertion and removal direction and configured to allow the worker or the like to determine the complete engagement state with the mating connector C. The detection member 40 is assembled with the lock arm 31. The detection member 40 is assembled with the housing 20 so as to be arranged closer to the outside of the housing 20 than the lock arm 31 and at least the detachment direction side is arranged in the operation space 24*a* of the operation groove 24. Therefore, at least the detachment direction side of the detection member 40 is exposed to the outside in the operation space 24*a*. In the connector 1 of the present embodiment, the operation space 24*a* is also used as a space for the relative movement operation of the detection member 40. Thus, the detachment direction side of the detection member 40 is used as an operating portion for the relative movement operation. In addition, the detection member 40 includes a base body 41, a wall body 42, a guided portion 43, a detection member operating portion 44, a temporary locking release portion 45, a locking protrusion 46 for main locking, a detection member protruding body 47, and a restriction protruding body 48.

Figure 7:
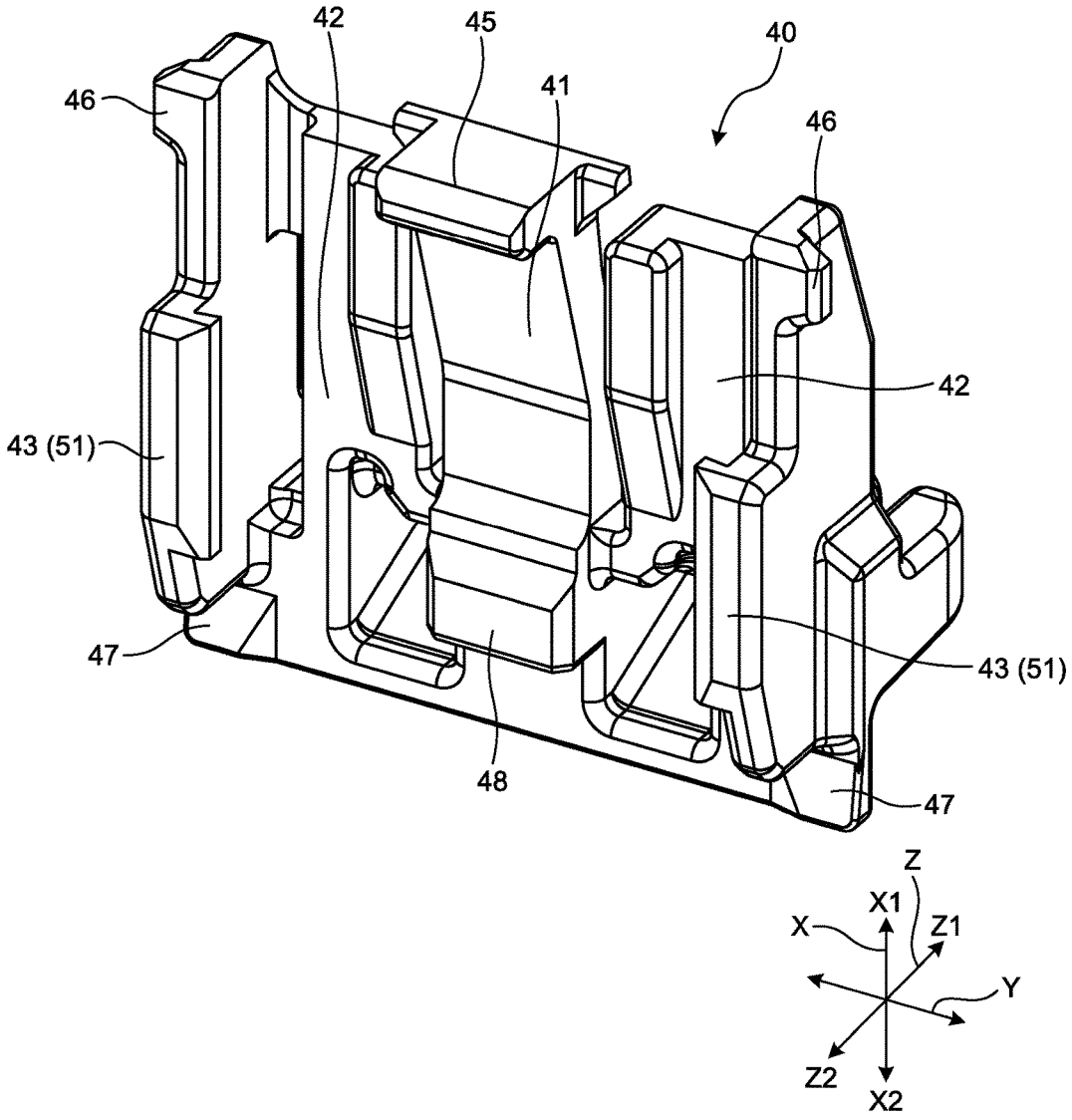
FIG. 7 is a perspective view illustrating a detection member according to the embodiment.

As illustrated in FIG. 7, the base body 41 is formed so as to be arranged with an interval with respect to the base portion 31*a* of the lock arm 31 after attaching the detection member 40 to the housing 20. For example, the base body 41 may be a rectangular piece-shaped molded body having one flat surface facing the base portion 31*a* in the downward direction, and may be one obtained by forming various notches, grooves, and the like in such a piece-shaped molded body.

A pair of the wall bodies 42 is formed from both end portions of the base body 41 in the arrangement direction toward the respective side walls 24$a_1$. The guided portion 43 is formed at each distal end of the wall bodies 42, and is formed and arranged so as to be capable of facing the guide portion 31*f* of the lock arm 31 in the engagement direction in a detection member movement step. The relative movement of the detection member 40 is guided in the engagement direction with respect to the housing 20 by the locking between the guide portion 31*f* and the guided portion 43. In the present embodiment, the detection member 40 is attached to the lock arm 31, and a guide structure 51 formed of the guide portion 31*f* and the guided portion 43 is provided between the detection member 40 and the lock arm 31. In this guide structure 51, a guide groove serving as the guide portion 31*f* is provided in the release lever portion 31*c*, and a guide protrusion serving as the guided portion 43 is provided in the detection member 40. In addition, each of the wall bodies 42 has a guide surface 42*a* formed on a surface on the side wall 24$a_1$ side. Each of the guide surfaces 42*a* is an inclined surface that is directed toward a side opposite to the side wall 24$a_1$ side as being directed in the downward direction. Each of the guide surfaces 42*a* is formed to come into contact with the side wall 24$a_1$ when the guided portion 43 passes over the guide portion 31*f* in the downward direction at the time of inserting the detection member 40 into the housing 20. Therefore, when the guided portion 43 passes over the guide portion 31*f* in the downward direction, each of the wall bodies 42 of the detection member 40 is widened in the width direction toward the side wall 24$a_1$. At this time, however, the guide surface 42*a* comes into contact with the side wall 24$a_1$ so that the detection member 40 can be easily inserted into the housing 20.

As illustrated in FIG. 1, the detection member operating portion 44 is formed so as to protrude from the base body 41 in the upward direction in the operation space 24*a*, and is used when the worker or the like performs the relative movement of the detection member 40. The detection member operating portion 44 protrudes outward from the lock wall 25*a* of the housing 20 and has a release operation surface 44*a* and an engagement operation surface 44*b*. The release operation surface 44*a* is positioned on the engagement direction side and is formed to face the detachment direction, and the engagement operation surface 44*b* is positioned on the detachment direction side and is formed to face the engagement direction. As illustrated in FIG. 5, the engagement operation surface 44*b* is formed as an inclined surface that protrudes toward the detachment direction as being directed in the downward direction from an end surface in the upward direction of the engagement operating portion 44. The worker pushes the engagement operation surface 44*b* in the engagement direction when moving the detection member 40 in the engagement direction, but a force toward the engagement direction and the downward direction acts on the detection member 40 since the engagement operation surface is the inclined surface. Therefore, it is possible to suppress the temporary locking release portion 45 from lifting in the upward direction when moving the detection member 40 in the engagement direction. In addition, the engagement operation surface 44*b* may have a plurality of recesses formed continuously in the vertical direction. Each of the recesses has a first recessed surface positioned on the downward direction side and a second recessed surface positioned on the upward direction side when viewed from the width direction, and is formed such that a length of the first recessed surface is longer than a length of the second recessed surface. In addition, the first recessed surface is formed to be deeper than an inclination angle of the entire engagement operation surface 44*b*, that is, formed on an inclined surface toward the engagement direction side. The detection member operating portion 44 is formed so as to oppose the main body 21 with the support portion 31*d* sandwiched therebetween and to be positioned on the detachment direction side of the locking portion 31*b* at the locking release position.

As illustrated in FIG. 7, the temporary locking release portion 45 is formed so as to protrude from the end portion on the engagement direction side of the base body 41 toward the main body 21, and is formed and arranged so as to be capable of facing the locking portion 31*b* of the lock arm 31 in the engagement direction in the detection member movement step.

As illustrated in FIG. 3, the locking protrusion 46 for main locking is formed in each of the wall bodies 42 of the detection member 40 on the engagement direction side. The locking protrusion 46 for main locking protrudes so as to oppose each of the side walls 25*b* of the housing 20, and is formed and arranged so as to be capable of facing the locking body 26 of the housing 20 in the engagement direction in the detection member movement step.

As illustrated in FIGS. 3 and 7, a pair of the detection member protruding bodies 47 is formed in a rectangular parallelepiped shape so as to face the side wall 24$a_1$. The detection member protruding body 47 of the present embodiment is provided in the detection member operating portion 44. When viewed from the engagement direction, the detection member protruding body 47 is formed such that opposing sides facing the side walls 24$a_1$, which are on the distal end side of the detection member operating portion 44 on the base side, are short in the vertical direction, that is, a thickness, which is a length in the vertical direction, is thin. Here, the detection member protruding body 47 opposes the housing protruding body 27 in the upward direction and opposes the lock arm protruding body 31*g* in the downward direction when the detection member 40 is at the locking release position. That is, the detection member protruding body 47 is sandwiched between the housing protruding body 27 and the lock arm protruding body 31*g* in the vertical direction in the locking release position. At this time, the distal end side of the detection member protruding body 47 is positioned on the base side of the housing protruding body 27 and the lock arm protruding body 31*g* in the vertical direction. Therefore, when viewed from the engagement direction, a total length of the housing protruding body 27, the lock arm protruding body 31*g*, and the detection member protruding body 47 in the vertical direction can be shortened as compared with the case where the housing protruding body 27, the lock arm protruding body 31*g*, and the detection member protruding body 47 have a rectangular shape. As a result, the length of the connector 1 in the vertical direction can be suppressed, and the connector 1 can be downsized.

As illustrated in FIGS. 6 and 7, the restriction protruding body 48 is formed so as to protrude in the downward direction from a lower surface of the base body 41 which is a face on the downward direction side. The restriction protruding body 48 is formed at a position overlapping a part of at least one of the locking portion 31*b* and the locked portion 32 on the lower surface of the base body 41 when the detection member 40 is at the main locking position as viewed from the vertical direction. Therefore, since a part of the restriction protruding body 48 overlaps either the locking portion 31*b* or the locked portion 32 when the detection member 40 is at the main locking position, it is possible to narrow a gap with respect to the detection member 40 in the vertical direction as compared with the case where the restriction protruding body 48 is not provided. As a result, the locking portion 31*b* comes into contact with the restriction protruding body 48 in the vertical direction even when the locking portion 31*b* tries to pass over the locked portion 32*a* in the detachment direction in the complete engagement state, and the locking portion 31*b* is prevented from passing over the locked portion 32*a* in the detachment direction, and thus, it is possible to reliably maintain the complete engagement state.

The detection member 40 can be relatively moved with respect to the housing 20 between the temporary locking position, the main locking position, and the release position (the detection member movement step). The temporary locking position is a position of the detection member 40 with respect to the housing 20 when the engagement state between the connector 1 and the mating connector C is the engagement release state, and is the position at which the detection member 40 is not positioned between the lock wall 25*a* and the locking portion 31*b*. The temporary locking position in the present embodiment is also the locking release position. The temporary locking position and the locking release position in this example are also positions when the detection member 40 is assembled with the housing 20. Thus, the temporary locking position includes not only a state before the connector 1 and the mating connector C are inserted into each other, and the locking release position also includes a state after the connector 1 and the mating connector C are detached from each other. The main locking position is a position of the detection member 40 with respect to the housing 20 when the engagement state between the connector 1 and the mating connector C is in the complete engagement state, and is the position at which at least a part of the detection member 40 is positioned between the lock wall 25*a* and the locking portion 31*b*. The detection member 40 according to the present embodiment can relatively move with respect to the housing 20 in the insertion and removal direction, reaches the main locking position when being relatively moved from the temporary locking position in the engagement direction, and reaches the locking release position by being relatively moved from the main locking position in the detachment direction.

Next, the engagement between the connector 1 and the mating connector C will be described. The connector 1 is moved in the engagement direction such that the mating housing Ch is inserted into the annular space 23 of the housing 20 in a state where the detection member 40 is at the temporary locking position as illustrated in FIG. 5. When the connector 1 moves in the engagement direction, the locking portion 31*b* and the locked portion 32*a* abut on each other. After the locking portion 31*b* and the locked portion 32*a* abut on each other, the locking portion 31*b* is pushed in the upward direction by the locked portion 32*a* as the connector 1 continues to move in the engagement direction, and the locking portion 31*b* passes over the locked portion 32*a* until reaching the position to form the complete engagement state while bending the lock arm 31. In addition, the worker or the like may move continuously move the connector 1 in the engagement direction so that the locked portion 32*a* is moved to the position to form the complete engagement state after the locking portion 31*b* of the lock arm 31 is bent in the upward direction.

After the locked portion 32*a* pushes the locking portion 31*b* in the upward direction, the temporary locking release portion 45 comes into contact with the locked portion 32*a* as the connector 1 continues to move in the engagement direction. Then, as the movement of the connector 1 in the engagement direction progresses, the locked portion 32*a* applies a force in the upward direction to the temporary locking release portion 45. At that time, the base body 41 begins to deflect with the base on the engagement release direction side as a fulcrum, in the detection member 40.

Figure 9:
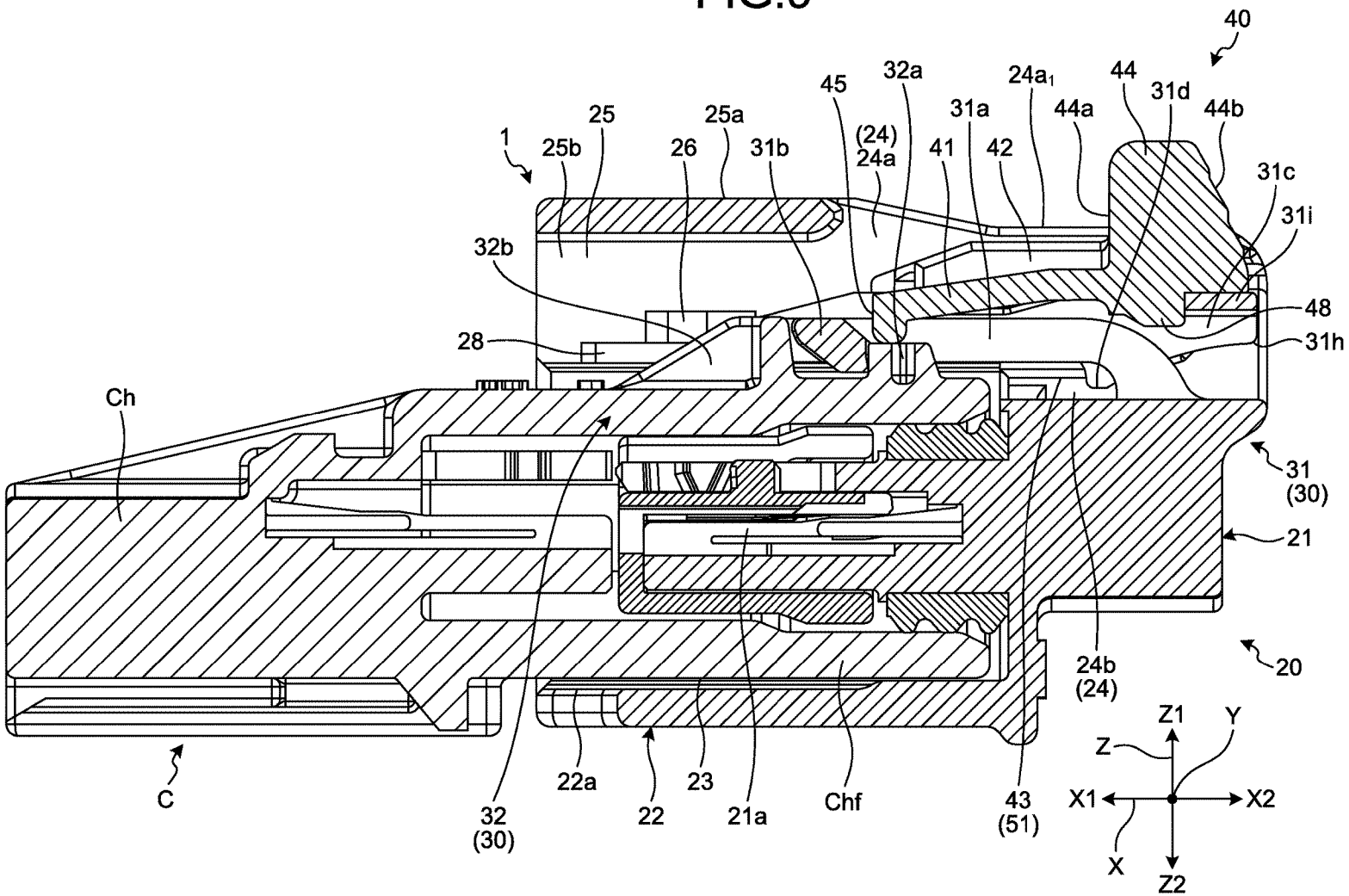
FIG. 9 is a view of the detection member at the temporary locking position before reaching the main locking position in FIG. 6 and the release position in the engagement release state.
Figure 10:
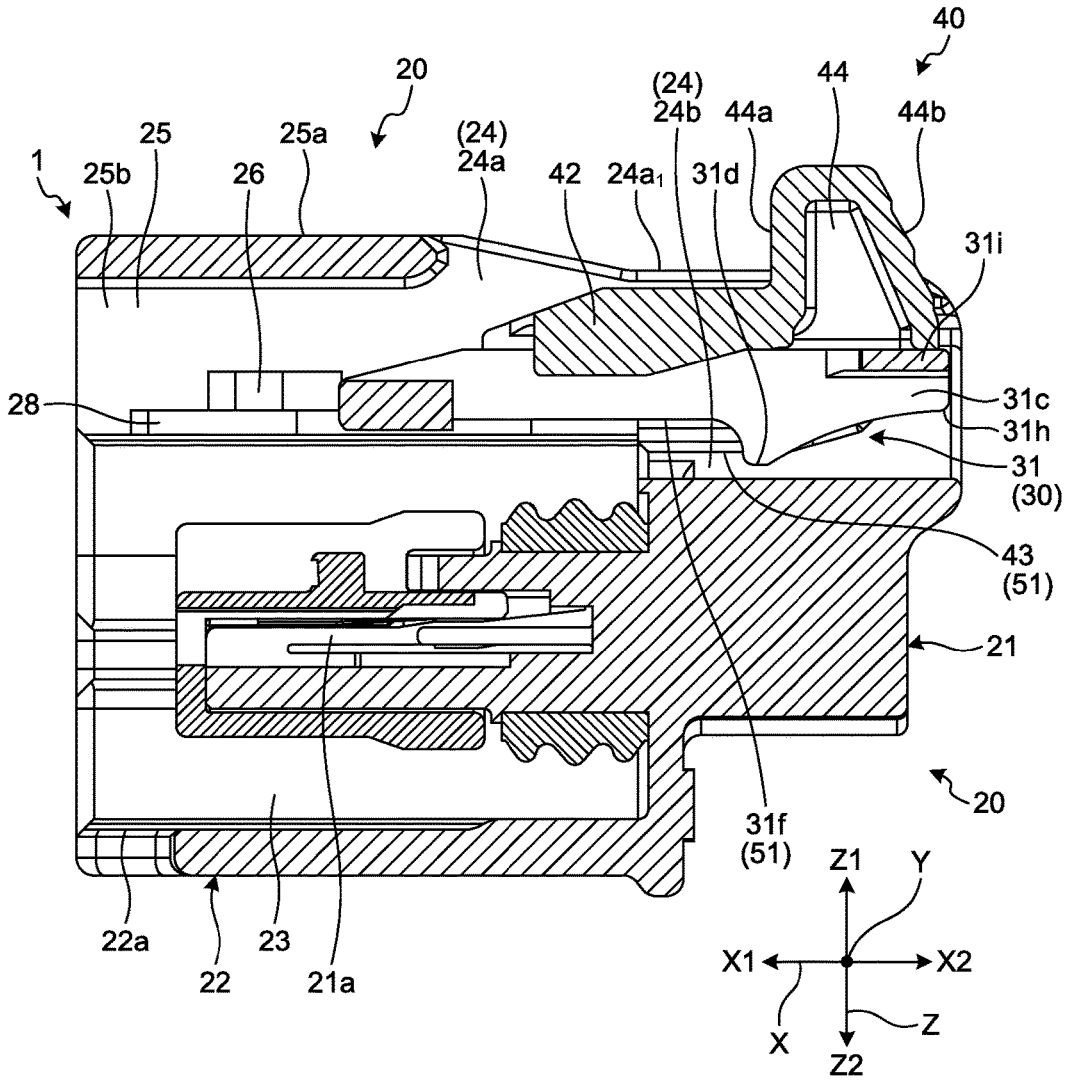
FIG. 10 is a cross-sectional view taken along a line Z-Z in FIG. 2 and is the view of the detection member at the temporary locking position and the release position.

At the position to form the complete engagement state, the lock arm 31 that has deflected is elastically restored, and the locking portion 31*b* and the locked portion 32*a* face each other in the insertion and removal direction as illustrated in FIG. 9. Since a removal operation between the connector 1 and the mating connector C is suppressed in the holding structure 30, the connectors are held in the complete engagement state. In addition, in the detection member 40, the base body 41 deflects up to a position at which the temporary locking release portion 45 can pass over the locking portion 31*b*.

As illustrated in FIG. 9, the locking portion 31*b* of the lock arm 31 approaches the release operating portion 32*b* by being moved in the engagement direction to the position to form the complete engagement state. The movement of the locking portion 31*b* toward the engagement direction side is locked by the end portion of the release operating portion 32*b* by reducing an interval at the position to form the complete engagement state between the locking portion 31*b* and the release operating portion 32*b*. The movement of the lock arm 31 toward the engagement direction side in the complete engagement state is restricted by using the locking portion 31*b* and the end portion of the release operating portion 32*b*.

Next, the restriction of the movement of the detection member 40 in a relative movement direction with respect to the housing 20 at the temporary locking position will be described. As illustrated in FIG. 5, a temporary locking structure that restricts the movement of the detection member 40 in the relative movement direction (insertion and removal direction) with respect to the housing 20 at the temporary locking position is provided between the detection member 40 and the housing 20. The temporary locking structure locks the movement of the detection member 40 toward the detachment direction side by the lock arm protruding body 31*g* and the wall body 42, and locks the movement of the detection member 40 toward the engagement direction side by the locking portion 31*b* and the temporary locking release portion 45.

The structure in which the movement of the detection member 40 toward the detachment direction side is restricted at the temporary locking position will be described. As illustrated in FIG. 3, the lock arm protruding body 31*g* is arranged on the detachment direction side of the wall body 42 and opposes the end portion on the detachment direction side of the wall body 42 in the insertion and removal direction, so that the movement of the wall body 42 toward the detachment direction side is restricted by the lock arm protruding body 31*g*. The movement of the detection member 40 toward the detachment direction side with respect to the lock arm 31 (the housing 20) at the temporary locking position is restricted by the lock arm protruding body 31*g* and the wall body 42. The lock arm protruding body 31*g* and the wall body 42 may come into contact with each other in the insertion and removal direction or may be arranged with an interval therebetween in the insertion and removal direction when the detection member 40 is at the temporary locking position.

The structure in which the movement of the detection member 40 toward the engagement direction side is restricted at the temporary locking position will be described. The temporary locking release portion 45 restricts the movement of the detection member 40 toward the engagement direction side in the accommodating space 25 at the temporary locking position before the mating connector C is inserted. When the detection member 40 is at the temporary locking position before the mating connector C is inserted, the locking portion 31*b* is arranged to oppose the temporary locking release portion 45 in the insertion and removal direction, thereby restricting the movement of the temporary locking release portion 45 toward the engagement direction side as illustrated in FIG. 5. When the detection member 40 is at the temporary locking position before the mating connector C is inserted, the movement of the detection member 40 toward the engagement direction side with respect to the lock arm 31 (the housing 20) is restricted by the locking portion 31*b* and the temporary locking release portion 45. At that time, the locking portion 31*b* and the temporary locking release portion 45 may come into contact with each other in the insertion and removal direction, or may be arranged with an interval therebetween in the insertion and removal direction.

Next, the relative movement of the detection member 40 from the temporary locking position to the main locking position will be described. As illustrated in FIG. 9, the detection member 40 relatively moves with respect to the housing 20 from the temporary locking position to the main locking position by moving the temporary locking release portion 45 beyond the locking portion 31*b* toward the engagement direction in the state where the detection member 40 is at the temporary locking position in the complete engagement state. As a result, the base body 41, which is a part of the detection member 40, is positioned between the lock wall 25*a* and the locking portion 31*b*.

In addition, a groove, surrounded by the base body 41, the wall body 42, and the guided portion 43, is formed at the end portion on the side wall $24a_1$ side of the detection member 40 along the insertion and removal direction. When being assembled to the lock arm 31, the detection member 40 is held by the lock arm 31 as the lock arm 31 is accommodated in the groove of the detection member 40. With the above-described configuration, it is possible to perform guidance when the detection member 40 relatively moves in the insertion and removal direction with respect to the lock arm 31, and to suppress the detachment of the detection member 40 from 31 (detachment in a direction different from the relative movement direction).

Next, the restriction of the movement of the detection member 40 in a relative movement direction with respect to the housing 20 at the main locking position will be described. As illustrated in FIG. 6, a main locking structure that restricts the movement of the detection member 40 in the relative movement direction (insertion and removal direction) with respect to the housing 20 at the main locking position is provided between the detection member 40 and the housing 20. The main locking structure restricts the movement of the detection member 40 toward the detachment direction side by the locking body 26 and the locking protrusion 46 for main locking and restricts the movement of the detection member 40 toward the insertion direction side by the detection member operating portion 44 and the lock wall 25*a*.

The structure in which the movement of the detection member 40 toward the detachment direction side is restricted at the main locking position will be described. As illustrated in FIG. 6, the base body 41 is separated from the release operating portion 32*b* until the detection member 40 moves to the main locking position after the temporary locking state is released, and thus, the deflection of the base body 41 is gradually resolved. Here, when the detection member 40 finishes moving to the main locking position, the locking protrusion 46 for main locking is positioned on the engagement direction side of the locking body 26, thereby forming a state where the locking body 26 and the locking protrusion 46 for main locking oppose each other in the insertion and removal direction. Here, the respective locking bodies 26 restrict the movement of the locking protrusions 46 for main locking toward the detachment direction side. The movement of the detection member 40 toward the detachment direction side with respect to the lock arm 31 (the housing 20) at the main locking position is restricted by the locking body 26 and the locking protrusion 46 for main locking. At that time, the locking body 26 and the locking protrusion 46 for main locking may come into contact with each other in the insertion and removal direction, or may be arranged with an interval therebetween in the insertion and removal direction.

The structure in which the movement of the detection member 40 toward the insertion direction side is restricted at the main locking position will be described. As illustrated in FIG. 6, the detection member operating portion 44 approaches the lock wall 25*a* of the housing 20 as the detection member 40 relatively moves from the temporary locking position to the main locking position. The movement of the detection member operating portion 44 toward the engagement direction side is locked by the end portion of the lock wall 25*a* by narrowing the interval at the main locking position between the detection member operating portion 44 and the lock wall 25*a*. The movement of the detection member 40 toward the engagement direction side at the main locking position is restricted by using the detection member operating portion 44 and the end portion of the lock wall 25*a*.

Figure 8:
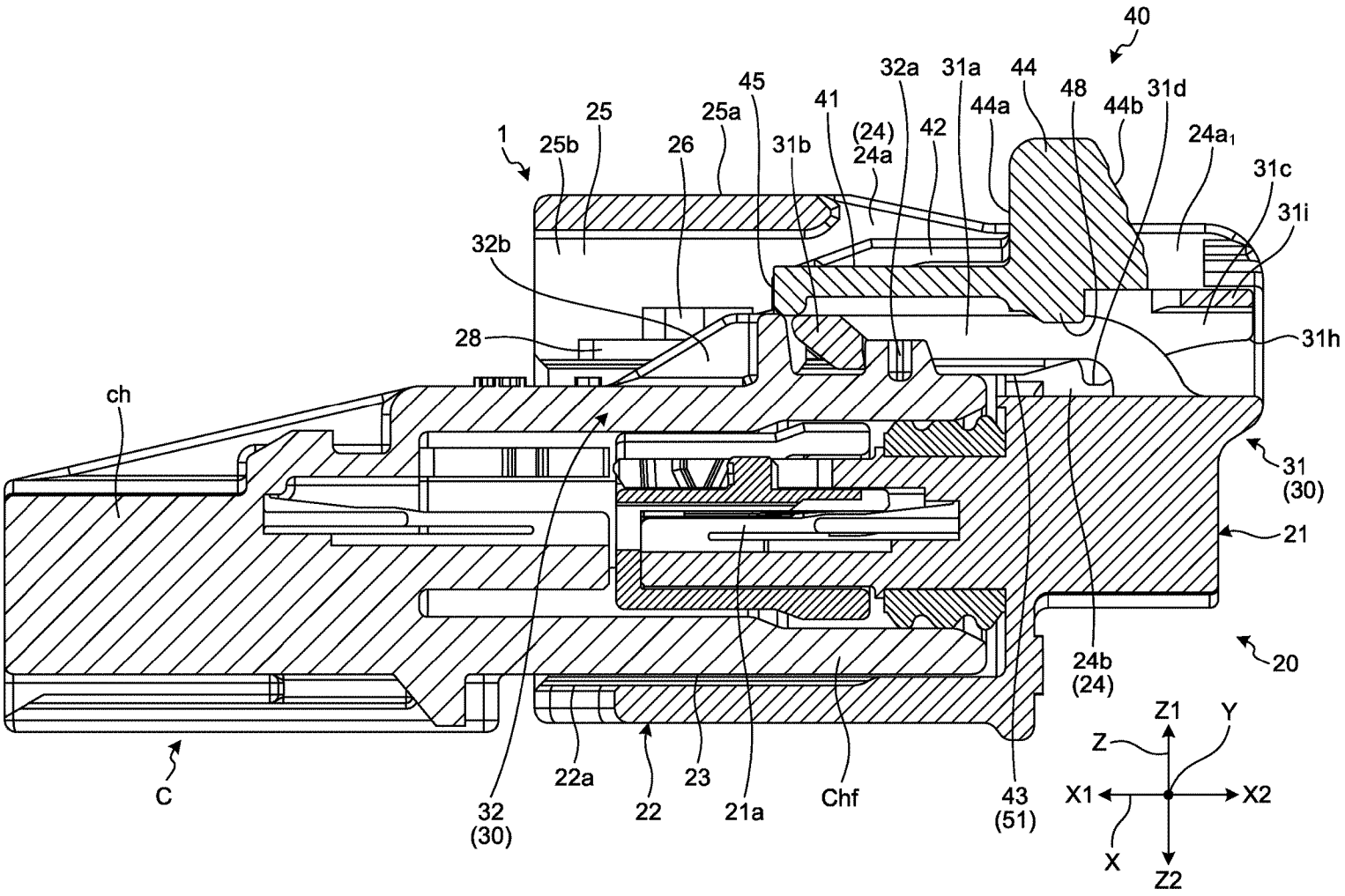
FIG. 8 is a view illustrating a state of the detection member during movement at a temporary locking position before reaching a main locking position in FIG. 6 and a release position in an engagement release state.

The relative movement of the detection member 40 from the main locking position to the release position will be described. As the worker pulls the release operation surface 44*a* in the detachment direction with a finger to move the detection member 40 in the detachment direction in the state where the detection member 40 is at the main locking position in the complete engagement state, the temporary locking release portion 45 comes into contact with the release operating portion 32*b* along with the progress of the movement as illustrated in FIG. 6. As the release progresses, the release operating portion 32*b* applies a force directed in the upward direction to the temporary locking release portion 45. At that time, the base body 41 begins to deflect with the base on the engagement release direction side as a fulcrum, in the detection member 40. In this detection member 40, the release further progresses, and the base body 41 deflects up to a position at which the temporary locking release portion 45 can pass over the release operating portion 32*b* as illustrated in FIG. 8. The detection member 40 relatively moves with respect to the housing 20 from the main locking position to the release position by moving the temporary locking release portion 45 over the release operating portion 32*b* toward the detachment direction side.

Figure 11:
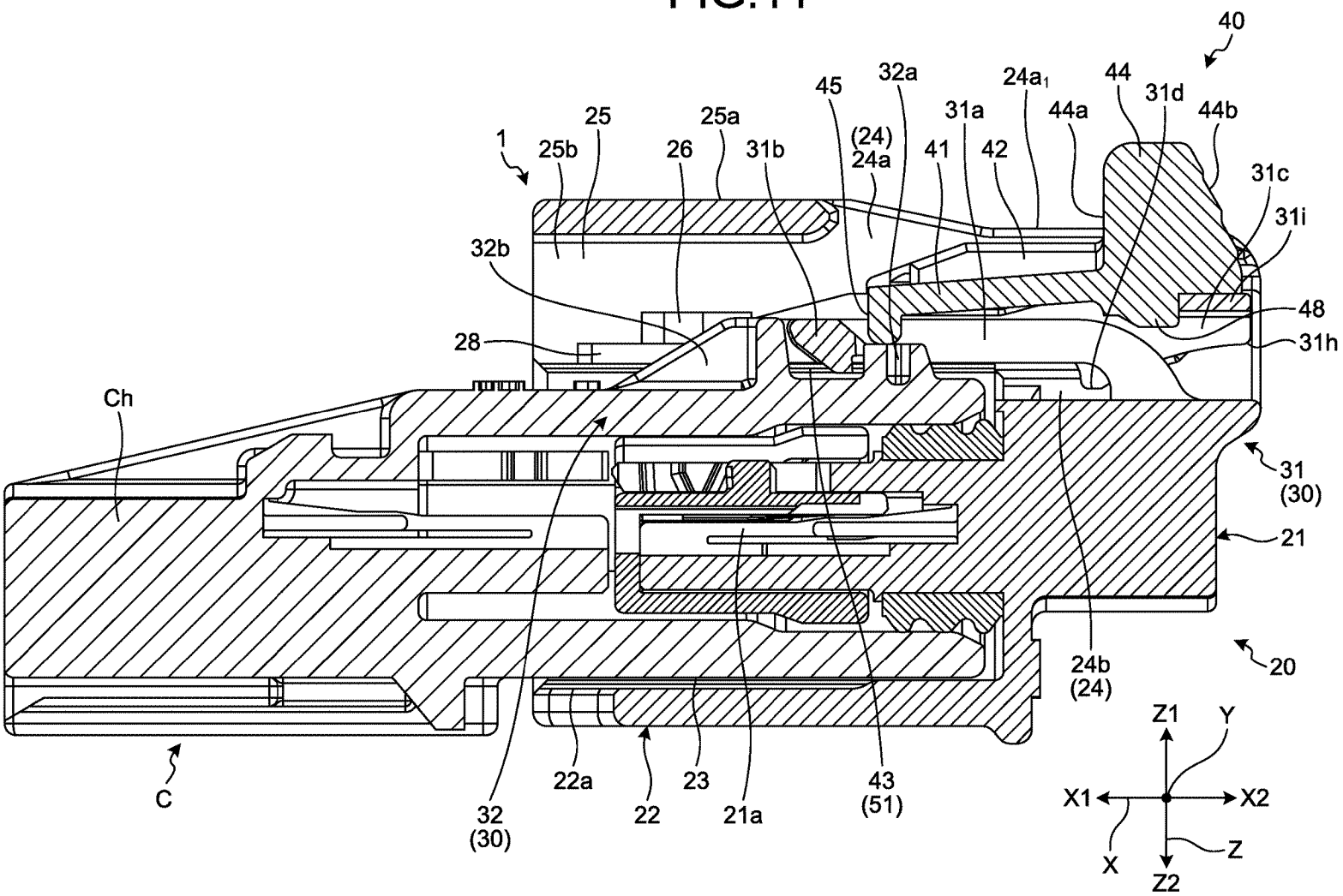
FIG. 11 is a view illustrating a state where a support portion and a main body in FIG. 9 abut on each other.
Figure 12:
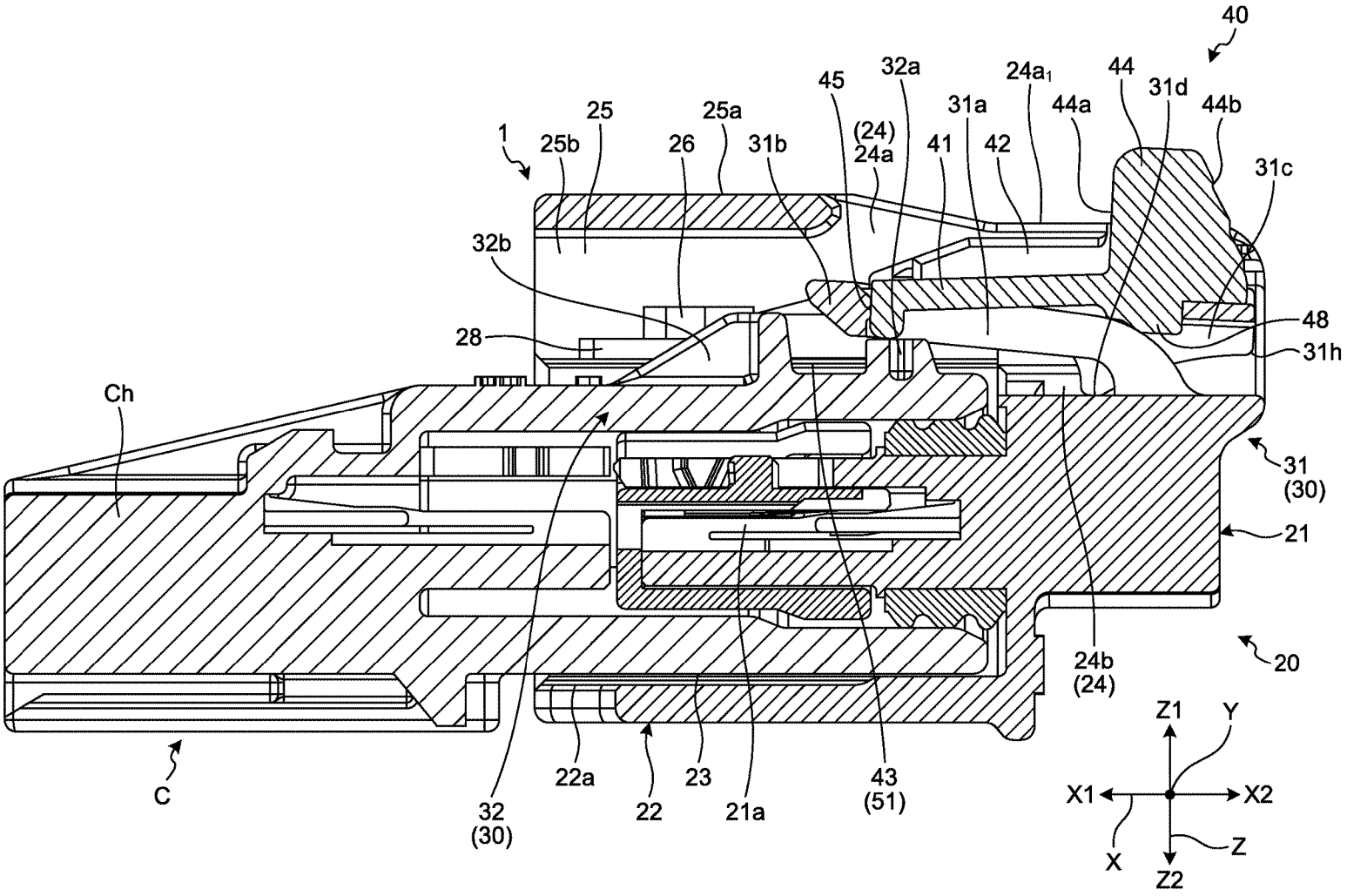
FIG. 12 is a view illustrating a state where a locking portion is rotated about the support portion by operating the detection member of FIG. 9.

The release of the complete engagement state in the connector 1 and the mating connector C will be described. As the worker continues to pull the release operation surface 44*a* in the detachment direction in the state where the detection member 40 is at the main locking position, the support portion 31*d* of the lock arm 31 is lowered and abuts on the main body 21 of the housing 20 as illustrated in FIGS. 11 and 12. As the release operation surface 44*a* is further pulled after the abutment, the release lever portion 31*c* of the lock arm 31 rotates about a fulcrum which is a contact point between the support portion 31*d* and the main body 21 by leverage, so that the detection member operating portion 44 moves in the detachment direction and the downward direction. As a result, the locking portion 31*b* connected to one end on the engagement direction side of the release lever portion 31*c* deflects in the upward direction, so that the locking portion 31*b* and the locked portion 32*a* do not face each other in the insertion and removal direction. Thus, the complete engagement state of the connector 1 and the mating connector C can be released by continuing to pull the release operation surface 44*a*, thereby forming the engagement release state. Incidentally, the detection member operating portion 44 opposes the main body 21 with the support portion 31*d* sandwiched therebetween and is positioned on the detachment direction side of the locking portion 31*b* in the engagement release state.

As described above, according to the connector 1 of the present embodiment, it is possible to continuously perform the movement of the detection member 40 from the main locking position to the locking release position and the engagement release of both the housings 20 and Ch by an operation performed by the worker applying an external force to the detection member operating portion 44. That is, it is possible to perform two operations by the single detection member 40. Therefore, it is unnecessary to perform the operation of disengaging both the housings 20 and Ch by taking off the finger and holding the lock arm operating portion after operating the detection member operating portion 44 as in the conventional connector. That is, it is possible to perform the operation of moving the detection member 40 from the main locking position to the locking release position and the operation of disengaging both the housings 20 and Ch by the detection member 40 which is the single member, and thus, it is possible to improve the workability until disengaging both the housings 20 and Ch and to easily detach the connectors from each other. In addition, since it is unnecessary to provide the lock arm operating portion as in the conventional connector, it is unnecessary to secure the area of the lock arm operating portion of the housing 20, and the downsizing can be realized.

In addition, it is unnecessary to secure the strength of the connection portion 31*i* of the release lever portion 31*c*, which corresponds to the conventional lock arm operating portion, in the connector 1 of the present embodiment, it is possible to reduce the length of the connection portion 31*i* in the vertical direction, that is, the thickness of the connection portion 31*i*. Therefore, it is possible to reduce the weight, size, and cost of the connector 1

In addition, since the release operation surface 44*a*, which is positioned on the engagement direction side and faces the detachment direction is provided, the worker can move the detection member 40 in the detachment direction by pulling the release operation surface 44*a* with the finger in the detachment direction, so that it is possible to further improve the operability of the detection member 40 at the time of release. In addition, as the worker continues to pull the release operation surface 44*a* in the detachment direction, it is possible to perform the operation of moving the detection member 40 from the main locking position to the locking release position and to perform a series of operations until performing the operation of disengaging both the housings 20 and Ch by the single operation. Thus, it is possible to obtain the state (locking release state) in which the detection member 40 is moved from the main locking position to the locking release position and the engagement release of both the housings 20 and Ch only by pulling the detection member 40 in the detachment direction, so that it is possible to easily detach the connectors from each other as compared to the conventional connector 1 in which a direction of operating the detection member 40 and a direction of operating the lock arm 31 are different.

In addition, the support portion 31*d* and the main body 21 are not fixed at the time of molding the housing 20, and thus, it is possible to secure the strength of a mold by forming a gap for removing the mold in the detachment direction.

In addition, since the support portion 31*d* is formed at the position overlapping one end on the detachment direction side of the base portion 31*a* when viewed from the arrangement direction, a length of the base portion 31*a* and a rotation radius of the locking portion 31*b* are substantially equal to each other. Thus, it is possible to improve the durability of the lock arm 31 as compared with the case where the length of the base portion and the rotation radius of the locking portion are different from each other.

Although the worker moves the detection member 40 in the detachment direction by pulling the release operation surface 44*a* with the finger in the detachment direction in the present embodiment, the invention is not limited thereto, and the release operation surface 44*a* may be pressed with the finger.

In addition, the release operation surface 44*a* is formed so as to face the detachment direction in the above embodiment, but the invention is not limited thereto, and the release operation surface 44*a* may be formed so as to face the downward direction or the detachment direction as proceeding in the downward direction.

In addition, the detection member 40 can be attached to and detached from the housing 20, and the lock arm operating portion may be formed in the release lever portion 31*c* in the above embodiment. As a result, it is possible to disengage both the housings 20 and Ch without the detection member 40 by operating the lock arm operating portion.

In addition, the gap is formed between the support portion 31*d* and the main body 21 in the state where the housing 20 is arranged alone in the above embodiment, but the invention is not limited thereto, and the support portion 31*d* may have a shape that abuts on the main body 21.

In addition, the support portion 31*d* is formed so as to overlap one end on the detachment direction side of the base portion 31*a* when viewed from the arrangement direction in the above embodiment, but the invention is not limited thereto, and the support portion 31*d* may be formed at a position different from one end on the detachment direction side of the base portion 31*a*.

In addition, in the above embodiment, for example, a structure may be formed in which an abutment surface facing a rear end of the detection member 40 is provided on the detachment direction side of the operation space 24*a* of the housing 20, and the abutment surface and the rear end of the detection member 40 are held at both ends of a spring, respectively, so that the movement of the detection member 40 from the temporary locking state to the main locking position is caused by an elastic force in the complete engagement state.

In addition, the worker performs the engagement release operation by continuing to pull the release operation surface 44*a* in the detachment direction when the detection member 40 is at the main locking position in the above embodiment. However, the invention is not limited thereto, and the engagement release operation may be performed by pulling the release operation surface 44*a* in a direction other than the detachment direction.

The connector according to the present embodiment has an effect that it is possible to easily perform the engagement release between the connectors.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A connector comprising:

a terminal;

a housing that accommodates and holds the terminal and is engaged with a mating housing by being releasably locked by causing a locking portion to be locked to a locked portion provided in the mating housing when an engagement state with a mating connector is a complete engagement state; and a detection member that is assembled to the housing and is relatively movable in an engagement direction and a detachment direction with respect to the housing between a main locking position when the engagement state is the complete engagement state and a locking release position when the engagement state is an engagement release state in which the complete engagement state is released, wherein the housing includes a main body, a lock wall that opposes the main body in an opposing direction, which is a direction orthogonal to the engagement direction, and sandwiches the locking portion together with the main body at the main locking position, and a flexible lock arm that is fixed to the main body, the detection member is attachable to the lock arm, the lock arm includes the locking portion, a base portion which extends in the engagement direction with one end fixed to an outer peripheral surface of the main body and has the locking portion at another end, and a release lever portion which extends in the detachment direction along the lock arm with one end connected to the locking portion, the release lever portion includes a support portion opposing the outer peripheral surface of the main body in the opposing direction, and the detection member includes a detection member operating portion at least a part of which is positioned between the lock wall and the locking portion at the main locking position and which opposes the main body with the support portion sandwiched between the detection member operating portion and the main body and is positioned on a side in the detachment direction of the locking portion without being positioned between the lock wall and the locking portion at the locking release position.

2. The connector according to claim 1, wherein the support portion is formed at a position overlapping one end of the base portion when viewed from a direction orthogonal to the engagement direction and the opposing direction.

3. The connector according to claim 1, wherein a gap is formed between the support portion and the main body.

4. The connector according to claim 3, wherein the support portion is formed at a position overlapping one end of the base portion when viewed from a direction orthogonal to the engagement direction and the opposing direction.

5. The connector according to claim 1, wherein the detection member is detachable from the lock arm, and the release lever portion includes a lock arm operating portion which opposes the main body with the support portion sandwiched between the release lever portion and the main body and is positioned on a side in the detachment direction of the support portion.

6. The connector according to claim 5, wherein the support portion is formed at a position overlapping one end of the base portion when viewed from a direction orthogonal to the engagement direction and the opposing direction.

7. The connector according to claim 5, wherein a gap is formed between the support portion and the main body.

8. The connector according to claim 7, wherein the support portion is formed at a position overlapping one end of the base portion when viewed from a direction orthogonal to the engagement direction and the opposing direction.

9. The connector according to claim 1, wherein the detection member operating portion has a release operation surface which is positioned on a side in the engagement direction and faces the detachment direction.

10. The connector according to claim 9, wherein the support portion is formed at a position overlapping one end of the base portion when viewed from a direction orthogonal to the engagement direction and the opposing direction.

11. The connector according to claim 9, wherein the detection member is detachable from the lock arm, and the release lever portion includes a lock arm operating portion which opposes the main body with the support portion sandwiched between the release lever portion and the main body and is positioned on a side in the detachment direction of the support portion.

12. The connector according to claim 11, wherein the support portion is formed at a position overlapping one end of the base portion when viewed from a direction orthogonal to the engagement direction and the opposing direction.

13. The connector according to claim 9, wherein a gap is formed between the support portion and the main body.

14. The connector according to claim 13, wherein the support portion is formed at a position overlapping one end of the base portion when viewed from a direction orthogonal to the engagement direction and the opposing direction.

15. The connector according to claim 11, wherein a gap is formed between the support portion and the main body.

16. The connector according to claim 15, wherein the support portion is formed at a position overlapping one end of the base portion when viewed from a direction orthogonal to the engagement direction and the opposing direction.

* * * * *